219-121
5/4/82

SR

XR 4,328,257

United States Patent [19]

Muehlberger et al.

[11] 4,328,257

[45] May 4, 1982

[54] SYSTEM AND METHOD FOR PLASMA COATING

[75] Inventors: Erich Muehlberger, San Clemente; Roland D. Kremith, Newport Beach, both of Calif.

[73] Assignee: Electro-Plasma, Inc., Irvine, Calif.

[21] Appl. No.: 97,723

[22] Filed: Nov. 26, 1979

[51] Int. Cl.[3] ..... B05D 1/08

[52] U.S. Cl. ..... 427/34; 219/121 P

[58] Field of Search ..... 427/34, 38, 423; 219/76.16, 121 P; 118/620

[56] References Cited

U.S. PATENT DOCUMENTS

| | | | |
|---|---|---|---|
| 3,010,009 | 11/1961 | Ducati | 427/34 |
| 3,179,783 | 4/1965 | Johnson | 219/76.16 |
| 3,493,415 | 2/1970 | Grisaffe et al. | 427/34 |
| 3,494,852 | 2/1970 | Doctoroff | 219/76.16 |
| 3,839,618 | 10/1974 | Muehlberger | 427/34 |
| 4,006,340 | 2/1977 | Gorinas | 427/34 |

*Primary Examiner*—John H. Newsome

*Attorney, Agent, or Firm*—Fraser and Bogucki

[57] ABSTRACT

Uniform protective coatings are deposited on components with a high strength bond by utilizing a supersonic plasma stream and a transferred arc system of selectively reversible polarity. By maintaining plasma stream velocity at a sufficiently high Mach number, and using stream temperatures and static pressures which establish a shock pattern characteristic that diffuses the arc, the workpiece is made cathodic relative to the plasma gun at predetermined intervals. This creates a sputtering effect in which electrons and atoms are ejected from the workpiece despite the impacting plasma flow and the ambient pressure level. This sputtering action is undertaken to clean the workpiece once it is sufficiently heated and to cause intermingling of molecules of the substrate material with molecules of a deposition powder injected into the plasma flow. This preparatory deposition, together with the clean workpiece surface, enables a subsequent buildup of securely bonded and high uniform material.

40 Claims, 6 Drawing Figures

SYSTEM AND METHOD FOR PLASMA COATING

BACKGROUND OF THE INVENTION

This invention pertains to plasma spraying techniques and particularly to systems and methods utilizing transfer arcs in a supersonic plasma stream.

Plasma spray processes are commercially used for coating precision parts with metals and ceramics that are resistant to high temperatures, wear, corrosion or other conditions. Plasma sprayers provide a high energy level stream of ionized gas that can heat a workpiece to a high temperature and also deposit a powder of a selected coating material onto the workpiece. The powder is injected into the plasma stream and is heated to a molten or plastic state and bonded upon impact to a preferably heated workpiece. In the present state of the art, coatings can be provided having densities of 70 to 90% of theoretical, with the bond between the coating and substrate being of a mechanical rather than a chemical or metallurgical nature. It is desirable to increase the average coating density and the strength of the bond, and also to improve the yield using the process. Yields are sometimes uncertain, and generally less than satisfactory, because the dynamics of the process are dependent upon a number of variables involving high energy levels that cannot be precisely controlled, such as the stream velocity, plasma temperature and pressure conditions. The density of the coating and the strength of the bond are dependent not only on these variables but also on the cleanliness and condition of the workpiece.

Transferred arc type plasma guns have been used for powder overlay coatings and more recently for powder spray coatings. In these types of devices, a primary cathode-anode arc within the gun creates the plasma by ionizing a gas stream, and a potential difference between the gun itself and the workpiece serves to establish the workpiece as an anode to which the transfer arc from the gun attaches. Because the arc normally attaches within a very small area on the workpiece, tending to erode the surface and restricting the deposition rate, some modern plasma spray systems operate in a fashion to create an arc diffusing shock pattern. A supersonic plasma stream is created, but the stream static pressure is held relatively low, approximately 1 atmosphere, by a pumping system coupled into the enclosure for the device. Using a plasma stream velocity in the range of Mach 2 to 3, the shock pattern on the workpiece distributes the arc and spreads the powder during deposition. The high gas and powder velocities, and the consequent increase in kinetic and mechanical impact energies of the coating material, produce coatings with improved densities (in the range of 96 to 99% of theoretical) and improved bond strengths. The expansion of the stream due to the dynamic pressure ratios also substantially increases the area over which coating is deposited on the workpiece. However, control over the process is still far less than ideal, again primarily because of the dynamnic nature of the process. In heating the workpiece with the plasma stream, for example, nonuniform buildup can occur and some oxidation can take place, reducing the integrity of the bond and effecting the rate of deposition of material. The presence of oxidation or other impurities on the part severely affects quality, and precleaning techniques do not resolve the problem. Also it is desirable to use a commerical gas, rather than a much more costly purified gas, for the plasma system. The stringent requirements and demands that are placed on parts, such as turbine blades, that are typically coated by this process in turn means that the parts must be rejected in quality control.

SUMMARY OF THE INVENTION

In systems and methods in accordance with the invention, a workpiece being heated by a supersonic plasma stream is arranged to function on demand as the cathode in a reversed transfer arc system. A sputtering effect is created, in which electron current flows from the workpiece toward the plasma gun, and atoms of surface material are excited and emitted from the surface to flow toward opposite charges or swept aside by the gas stream. The workpiece surface is thus cleaned of oxides and impurities so that an interface layer is presented in which impacting metallic or non-metallic powders are metallurgically diffused throughout the surface of the workpiece. The potential difference between the workpiece and the plasma gun is then reversed, or equalized so that the powder may continue to be deposited until a desired depth of coating is achieved. The sputtering action is created despite the existence of a relatively high stagnation pressure (in the range of 2 atmospheres or less down to 0.001 atmospheres) in the region of the workpiece surface. The supersonic plasma stream, transfer arc, and pressure relationships established create a shock region that not only diffuses the transfer arc but preferentially excites the impurities and results in their emission from the surface and subsequent elimination.

In a more specific example of systems in accordance with the invention, a workpiece mounted inside a closed chamber is disposed in the path of a plasma stream from a plasma gun mounted on a scanning mechanism. A vacuum pumping system coupled to the enclosed chamber maintains a selected low ambient pressure despite supersonic plasma flow from the gun in excess of Mach 3.2. The stream velocity and stream static pressure, as well as the plasma density, are selected to establish the shock pattern at the workpiece, and to provide a diffused arc attachment of predetermined size and shape onto the workpiece. A high transfer arc current, in excess of 100 amperes, and of negative polarity, is initially used between the workpiece and the plasma gun to initiate sputtering. With this system, a dummy workpiece, or dummy "sting", is positioned adjacent the workpiece to maintain the diffused pattern irrespective of the scanning angle and impact area of the plasma stream relative to the free end of the workpiece. It is advantageous to scan the plasma head in a traverse direction, in yaw movements both parallel and normal to the traverse direction, and vertically as well, and a reliable and versatile mechanism is provided for this purpose. Both the workpiece and dummy sting may also be continuously moved during impingement of the plasma stream to limit heat flux and control the excited surface regions. By introducing a yaw movement to the workpiece, coating uniformity is further improved. Using these features in combination, the workpiece can rapidly be heated to working temperature, with or without a transferred arc, cleaned by the removal of atoms from the workpiece at a controlled rate during reversal of the transfer arc for a predetermined interval, and then coated, with or without an overlap between the coating and the sputtering intervals. Coating may then be completed using the transfer arc if desired, or without the use of the transferred arc if thermal energy transfer would thereby become excessive.

BRIEF DESCRIPTION OF THE DRAWINGS

A better understanding of the invention may be had by reference to the following specification in conjunction with the accompanying drawings, in which.

DETAILED DESCRIPTION OF THE INVENTION

Figure 1:
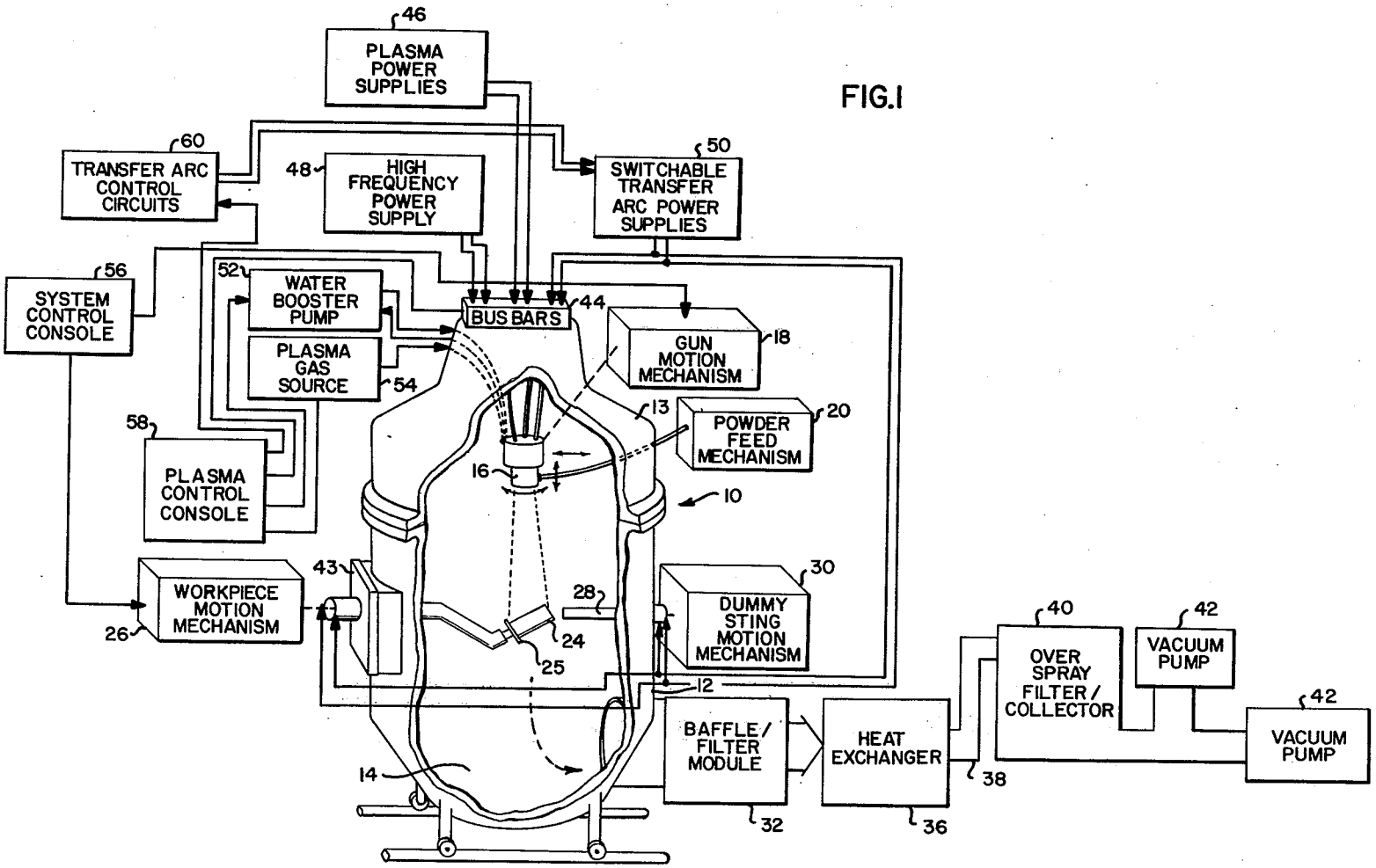
FIG. 1 is a combined block diagram and perspective view, partially broken away, of a system in accordance with the invention.
Figure 2:
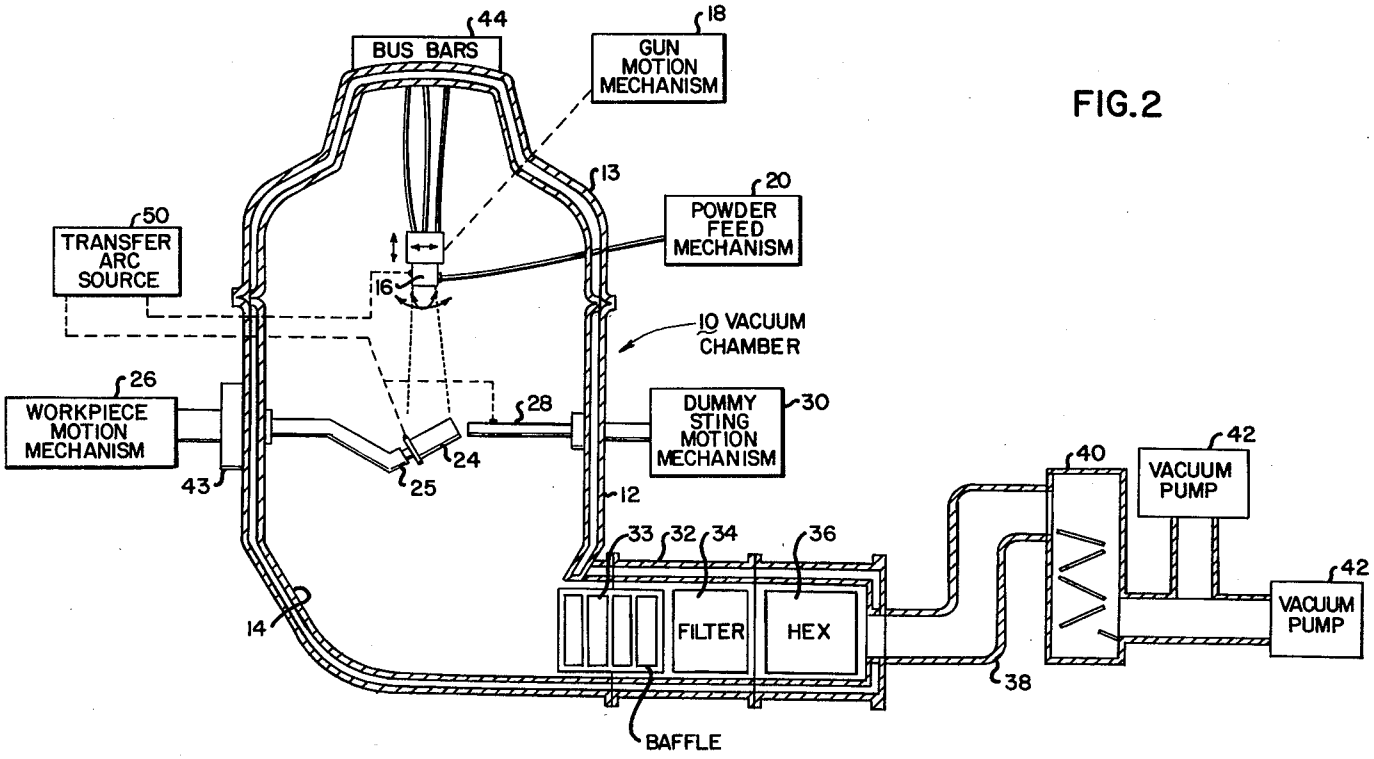
FIG. 2 is a simplified side sectional view of the system of FIG. 1, showing further details thereof.

As depicted generally in the broken away perspective view of FIG. 1 and the side sectional view of FIG. 2, a plasma spray system in accordance with the invention comprises principally a plasma chamber 10 that provides a sealed vacuum-maintaining and pressure-resistant insulative enclosure. The chamber 10 is defined by a cylindrical principal body portion 12, and an upper lid portion 13 joined thereto. The body portion 12 of the plasma chamber 10 includes a bottom collector cone 14 that leads into and communicates with associated units for processing the exiting gases and particulates and maintaining the desired ambient pressure. A downwardly directed plasma spray is established by a plasma gun or head 16 mounted within the interior of the chamber lid 13, the position of which gun 16 is controlled by a plasma gun motion mechanism 18 depicted only generally in FIGS. 1 and 2, but shown and described in greater detail hereafter in conjunction with FIGS. 3 and 4. Both parts of the plasma chamber 10 are advantageously constructed as double walled, water cooled enclosures and (not shown in detail) the lid 13 is removable for access to the operative parts. The gun motion mechanism 18 supports and controls the plasma gun 16 through sealed bearings and couplings in the walls of the chamber lid 13, in a fashion described in greater detail hereafter. A powder feed mechanism 20 also coupled to the chamber lid 13 provides controlled feed of a heated powder into the plasma spray through flexible tubes that are coupled to the plasma gun 16 at the plasma exit region.

Figure 5:
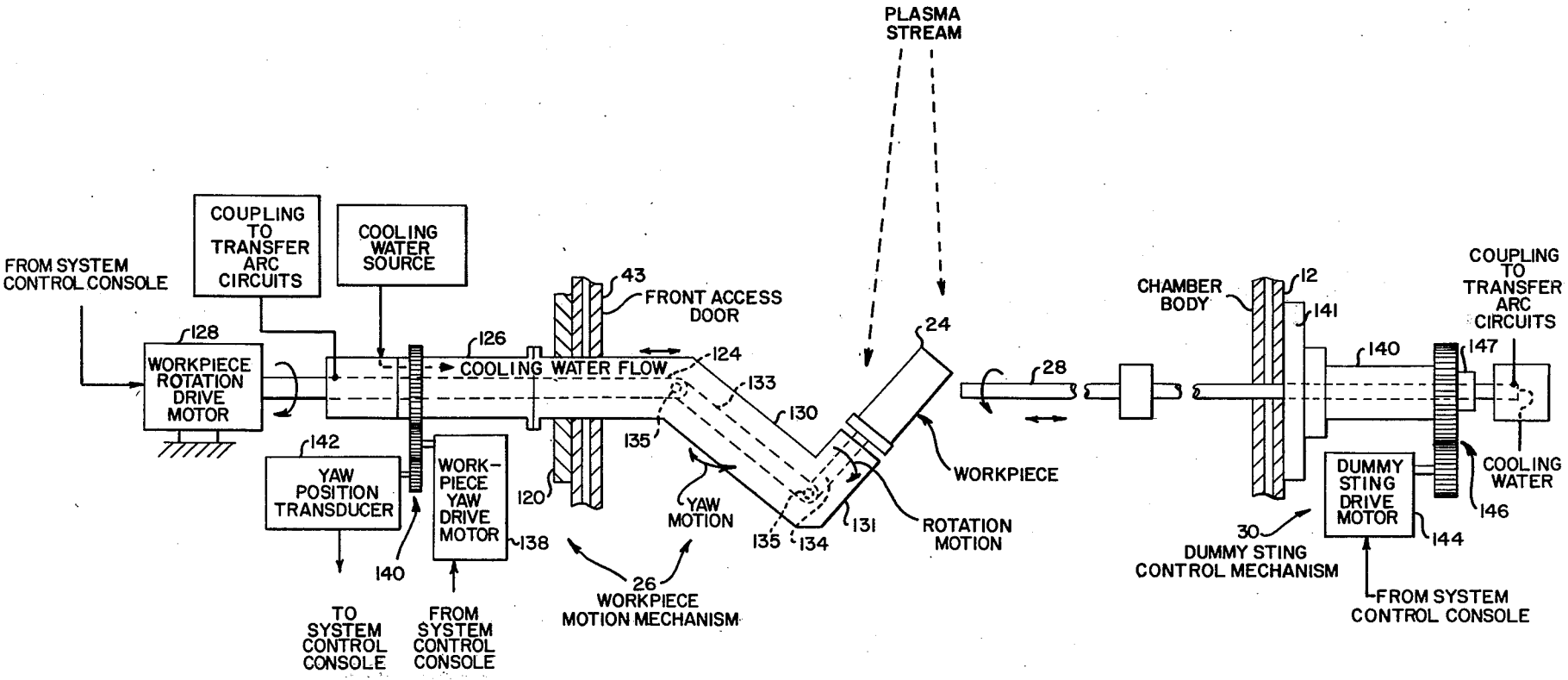
FIG. 5 is a fragmentary side view of a portion of the arrangement of FIGS. 1 and 2, showing further details of the workpiece and dummy sting mechanisms therein.

The downwardly directed plasma spray impinges on a workpiece 24 supported on an internally cooled conductive workpiece sting or holder 25 and positioned and moved while in operation via a shaft extending through the chamber body 12 to an exterior workpiece motion mechanism 26 shown and described in greater detail hereafter in conjunction with FIG. 5. Adjacent one end of the workpiece 24, but spaced apart therefrom, is a dummy workpiece or dummy sting 28, which is similarly internally cooled and coupled through a side wall of the chamber body 12 to a dummy sting motion mechanism 30. Both the workpiece holder 25 and the dummy sting 28 are adjustable as to insert position with respect to the central axis of the chamber 10 and electrically conductive so that they may be held at selected potential levels for transfer arc generation during various phases of operation.

Below the workpiece 24 and dummy sting 28 positions, the collector cone 14 directs the overspray gaseous and particulate materials into a baffle/filter module 32 having a water cooled baffle section 33 for initially cooling the overspray, and an in-line filter section 34 for extracting the majority of the entrained particle matter. Effluent passing through the baffle/filter module 32 is then directed through a heat exchanger module 36, which may be another water cooled unit, into a vacuum manifold 38 containing an overspray filter/collector unit 40 which extracts substantially all particulate remaining in the flow. The vacuum manifold 38 communicates with vacuum pumps 42 having sufficient capacity to maintain a desired ambient pressure within the chamber 10. Typically, this ambient pressure is in the range from 0.6 down to 0.001 atmospheres. The baffle/filter module 32 and the heat exchanger module 36, as well as the overspray filter/collector 40 are preferably double wall water cooled systems, and any of the types well known and widely used in plasma spray systems may be employed. The entire system may be mounted on rollers and movable along rails for ease of handling and servicing of different parts of the system. Conventional viewing windows, water cooled access doors and insulated feed through plates for electrical connection have not been shown or discussed in detail for simplicity. However, the workpiece support and motion control system is advantageously mounted in a hinged front access door 43 in the chamber body 12.

Electrical energy is supported into the operative portions of the system via fixed bus bars 44 mounted on the top of the chamber lid 13. Flexible water cooled cables (shown in FIGS. 3 and 4) couple external plasma power supplies 46 and a high frequency power supply 48 via the bus bars 44 into the plasma gun 16 for generation of the plasma stream. In a specific example, the plasma power supplies 46 comprised three 40 KW direct current sources. A 155 watt high frequency supply 48 is also utilized in this example to initiate the arc by superimposing a high frequency voltage discharge on the DC supply in known fashion. A switchable transfer arc power supply 50 comprising a 20 KW DC unit is coupled via the bus bars 44 to the plasma gun 16, workpiece holder 25, and dummy sting 28. As determined by applied control signals, a transfer arc potential is established between the plasma gun 16 on the one hand and the workpiece holder 25 (and workpiece 24) and dummy sting 28 on the other.

Operation of the plasma gun 16 entails usage of a water booster pump 52 to provide an adequate flow of cooling water through the interior of the plasma gun 16. A plasma gas source 54 provides a suitable ionizing gas for generation of the plasma stream. The plasma gas here employed is either argon alone or argon seeded with helium or hydrogen, although other gases may be employed, as is well known to those skilled in the art. In any event, the gas may be of regular commercial purity and need not be further purified so as to be essentially completely free of oxygen. Control of the sequencing of the system, and the velocity and amplitude of motion of the various motion mechanisms, is governed by a system control console 56. The plasma gun 16 is separately operated under control of a plasma control console 58. Inasmuch as the functions performed by these consoles and the circuits included therein are well understood, they have not been shown or described in detail. Transfer arc control circuits 60, however, are separately depicted in general form, because they control switching of the transfer arc polarity. The transfer arc control circuits 60 comprise conventional switches arranged to selectively reverse the polarity between the plasma gun 16 and the workpiece 24 and dummy sting 28, and to provide on-off control of the transfer arc. The transfer arc power supply 50 includes, in this example, relay circuits (not shown in detail) for controlling the polarity of electrical power applied to the bus bars 44.

Figure 3:
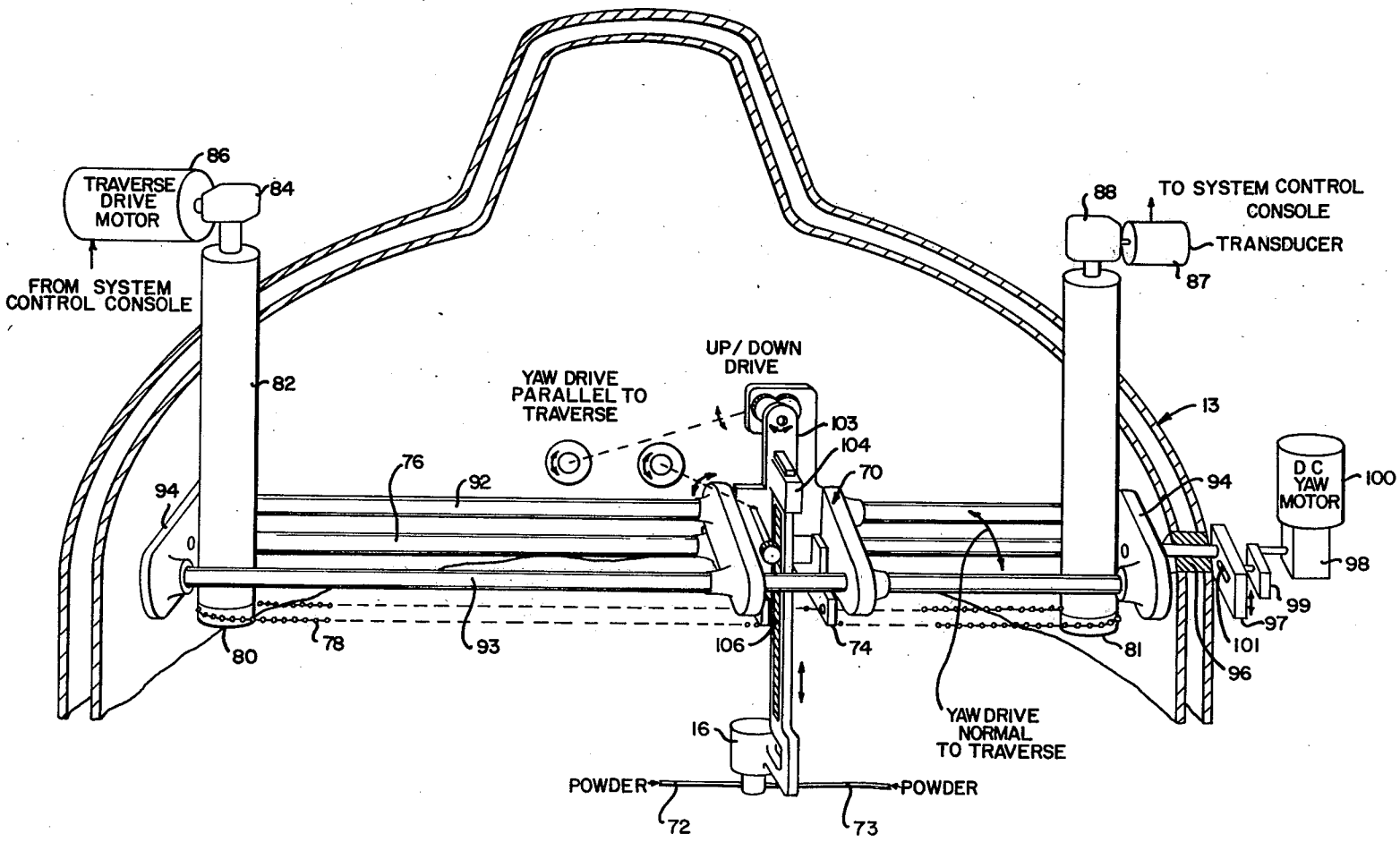
FIG. 3 is a perspective view of a portion of the system of FIG. 2, showing details of a plasma gun motion control mechanism used in the system.
Figure 4:
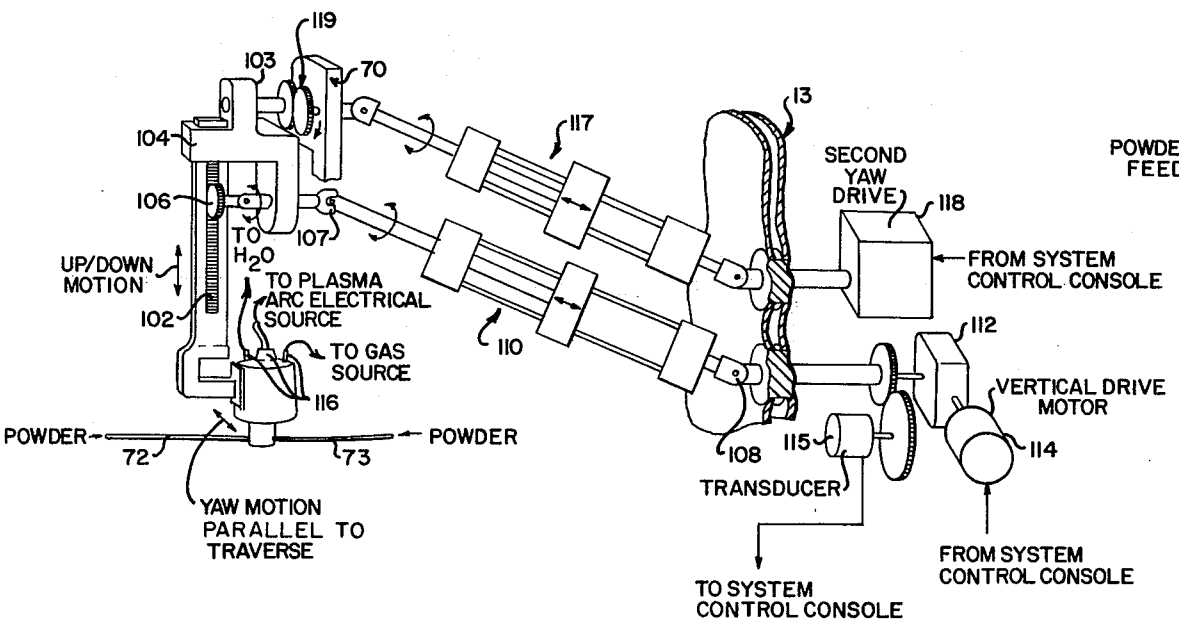
FIG. 4 is a side sectional view of the arrangement of FIG. 3.

Details of the plasma gun or head 16 and the plasma head motion mechanism 18 may be better appreciated by reference to FIGS. 3 and 4. The structure is mounted in the plasma chamber lid 13, and is here arranged to provide four movements in three directions of motion. The plasma gun 16 is supported via intermediate mechanisms from a carriage assembly 70 so as to face generally downwardly into the chamber body 12. Flexible hoses 72, 73, coupled through the lid 13 wall to the exterior powder feed mechanism 50, supply powder to the head, and because of the temperature of the chamber 10 also preheat the powder. A bracket 74 (FIG. 3 only) engaging the carriage assembly 70 is mounted to slide on a transverse water cooled shaft 76 which in this instance is horizontal and thus parallel to the traverse axis for the mechanism. Traverse motion is provided by a ball cable 78 joined to the bracket 74, extending generally parallel to the traverse axis, and turning about a drive sprocket 80 at one side of the chamber lid 13 and an idler sprocket 81 at the opposite side. The drive sprocket 80 is coupled through a sealed cylinder assembly 82 to an exterior traverse gear drive 84 and DC motor 86. These are arranged to provide, under control of the system control console 56 of FIG. 1, a speed of from 0 to 24 inches per second selectable at the option of an operator. In a practical example of the system, the total traverse was 36 inches, enabling coverage of a wide range of workpiece sizes. The limits of motion in the traverse direction are controllable by conventional means, such as a rotary transducer 87, driven from the shaft of the idler sprocket 81 through a sealed cylinder by a step-down gear assembly 88. It will be evident to those skilled in the art that the reciprocating motion at controllable velocity might be provided by various other expedients as well. However, using the present arrangement it becomes feasible to provide a more complex scanning motion to the plasma head 16, so as to achieve superior coating operation as well as operating versatility. A yaw motion, perpendicular to the traverse axis, is generated by arranging the carriage mechanism 70 to be slideable relative to the traverse axis along a pair of guide rods 92, 93 mounted between oscillating rocker plates 94, one of which is adjacent each side of the chamber lid 13. The rocker plates 94 pivot in sealed bearings 96 which lie on a common central axis, with a shaft through one of the bearings 96 being coupled exterior to the chamber lid 13 to a crank arm 97 that is driven from a gear box 98 coupled to a DC yaw motor 100. A deflection arm 99 extending from the gear box 98 shaft carries an eccentric pin 101 that engages a slot in the crank arm 97 to oscillate the rocker plates 94 and the yaw carriage mechanism 90. The radial position of the pin 101 relative to the shaft axis is adjustable (not shown in detail) to enable control of the yaw angle. Operation of the DC yaw motor 100 is governed by the system control console 56 to provide a controlled velocity when yawing perpendicular the plasma stream to the traverse direction. In this example the scan is from 0 to 48 inches per second over an angle of 30°.

A gimbal mechanism 103 is coupled to support the plasma head 16 on the carriage assembly 70 so that a reciprocating vertical motion and a parallel yaw motion can be added during the traverse and perpendicular (to the traverse axis) yaw actions. The gimbal mechanism 103 supports a nominally vertical splined shaft 102 which moves in a slideable relationship to a spline guide 104 mounted in the gimbal mechanism 103. A drive gear 106 mounted on the gimbal mechanism 103 is rotated in either direction to cause up or down motion of the splined shaft 102 and consequently the plasma head 16. For this purpose, as best seen in FIG. 4, a universal coupling 107 on the drive gear 106 axis, and another coupling 108 mounted in sealed relationship in the lid 13 wall are coupled together by a telescoping shaft mechanism 110. The exterior universal coupling 108 is connected to a vertical drive assembly that comprises a gear box 112 and DC motor 114, these being arranged to provide a selectable vertical speed of 0 to 20 inches per second over a given vertical range (here within a range of 24 inches). Again, the DC vertical drive motor 114 is governed from the system control console 56. A transducer 115 is coupled to the vertical drive system for providing a signal representative of plasma head position to the system control console.

The yaw motion parallel to the traverse axis is provided by a separate telescoping shaft 117 coupled from the lid side wall to the gimbal mechanism 103 at one side and to a second yaw drive 118 outside the chamber 10 at the other side. A gear train 119 coupling the telescoping shaft drive 117 to the gimbel mechanism 103 at its pivot axis provides oscillating movement of the plasma head 16 within a selected arc in the second yaw direction (parallel to the traverse axis). Transducer feedback forms part of the drive 118 in the fashion previously described. Water cooled cables 116 depicted only in fragmentary fashion in FIG. 4 are provided within the lid volume to couple the external bus bars 44, gas and water supplies to the plasma head 16.

This arrangement enables the motions to be controlled in each of the different directions independently of the others, both in rate and in amplitude. It should be noted that the four motions in three dimensions described by the plasma head 16 do not interfere with the lines supplying gases, electricity and powder to the plasma head 16.

The workpiece motion mechanism 26 and dummy sting motion mechanism 30 shown in general form in FIGS. 1 and 2 are shown in greater detail in FIG. 5. Each is arranged to provide internal water cooling of the mechanism and to enable electrical connection to the associated workpiece 24 and dummy sting 28 respectively. Referring now to FIG. 5, the workpiece motion mechanism 26 provides more features than the dummy sting motion mechanism 30, but it will be recognized that similar mechanisms may be utilized. It will also be recognized that the dummy sting motion mechanism 30 may be used to support a small workpiece for spraying if desired. The workpiece 24 is principally supported from a mounting flange 120 which may be conveniently coupled, as shown, to the front access door 43 on the chamber. An electrically conductive workpiece holder shaft 124 (also sometimes called a sting) is disposed along a given axis intersecting the central axis of the vacuum chamber 10. The dummy sting 28 is disposed along an axis normal or coaxial with the shaft 124, and is similarly rotatable, but is spaced apart from the workpiece 24 at its free end so that neither physical contact nor electrical connection exists. The conductive support shaft 124 is inserted so that the workpiece 24 is at a desired position relative to the central axis of the chamber 10, by moving the shaft 124 and an encompassing sleeve 126 seated within and extending exterior to the door 43. The dummy sting 28 is correspondingly inserted, and set at a position at which its end is close to but spaced from the workpiece 24. The sleeve assembly 126 incorporates internal water passageways for the flow of cooling water, and electrical circuit couplings, including a brush contacting a conductor that is in circuit with the central shaft 124, these elements not being shown in detail inasmuch as similar constructions are widely used in the art. Seal bearings and O-rings in the sleeve assembly 126 enable the sleeve assembly 126 and the shaft 124 to be slideably moved in or out and to be rotated without gas or water leakage. A DC gear motor 128 coupled to the shaft 124 exterior to the sleeve assembly 126 is coupled to the system control console 56, and is operable to provide workpiece 24 rotation at a speed of 0 to 100 rpm in this example.

The workpiece motion mechanism 26 also includes, however, a gooseneck coupling, interior to the chamber 10, supporting the workpiece 24 within the plasma spray target area. A gooseneck extension 130 of the sleeve 126 terminates in an end arm 131 that is canted upwardly relative to the horizontal axis. Extensions 133, 134 of the shaft 126 are coupled by universal joints 135 which enable the terminal extension 134 to rotate the workpiece 24 independently of motion of the sleeve 126 and gooseneck extension 130. A yaw motion is imparted to the workpiece by rotating the sleeve 126 through a limited arc by a yaw drive motor 138 receiving signals from the system control console. A gear coupling 140 between the motor 138 and the sleeve 126 also drives a yaw position transducer 142 (e.g. a potentiometer) that enables the limit positions of the yaw movement to be sensed and adjustably controlled in known fashion. Thus, in summary, the workpiece 24, after mounting on the free end of the shaft extension 131, is longitudinally inserted to a selected position in the path of the plasma stream. With a selected potential from the transfer arc circuits coupled to the workpiece 24 via the shaft 124 and its extensions 130, 131, and with cooling water circulating within the gooseneck 130, the workpiece 24 is both rotated and yawed within the plasma stream. The motion need not be used concurrently, and a gooseneck extension need not be employed for many parts.

In the example being discussed of a specific system the sting or shaft 124 is of 2 inch diameter. The dummy sting 28 is a straight shaft of 1 inch diameter, extending through a sleeve 140 and flange 141 mounted on the chamber 12 wall, and rotatable within the sleeve 140 by a drive motor 144 through a gear train 146 and locking flange 147. The locking flange 147 may be loosened to permit the dummy sting 28 to be inserted to a selected position, and then tightened to provide rotation under motor 144 control. A selectable rotation rate of 0 to 100 rpm is used for the dummy sting 28, which includes interior conduits (shown only generally) for receiving and circulating cooling water. As with the workpiece 24, the dummy sting 28 is maintained at a selected potential level from the transfer arc circuits.

In the operation of the system, the motion control mechanisms are operated concurrently and in interrelated fashion, in the sense that although they are independently adjustable the conditions are selected for optimum relationships for a particular workpiece 24. If the workpiece 24 is a turbine blade, for example, it is positioned with a given relationship to the central axis and then rotated at a rate depending upon its size, the material used, and the depth of coating desired. The dummy sting 28 is rotated at a related velocity. The plasma head 16 is operated to initiate the plasma, being energized by the power supplies 46 and 48 as gas flow and cooling water flow are maintained. Motion of the plasma head motion mechanism 18 is also commenced along the traverse axis concurrently with vertical reciprocation and yaw motion.

Figure 6:
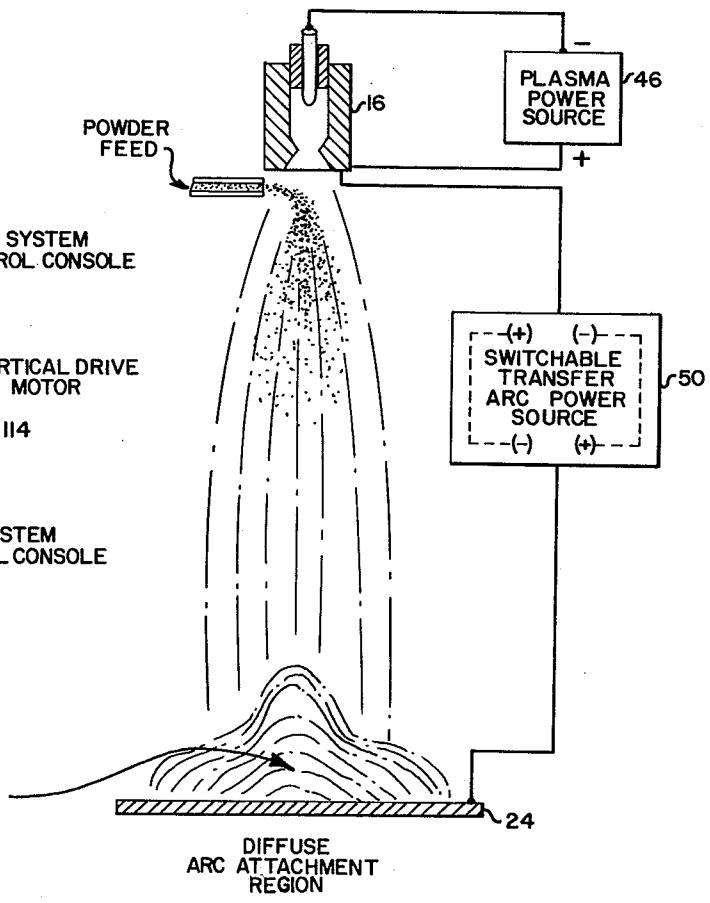
FIG. 6 is an idealized and simplified schematic view of a portion of a plasma spray system in accordance with the invention, illustrating plasma stream, shock pattern and arc diffusion effects.

The operating conditions established within the plasma chamber 10 involve the interrelationship between the plasma stream and the vacuum environment, and are of significance. The ambient pressure in the plasma chamber is held, by the vacuum pumps 42, in the range of 0.6 to 0.001 atmospheres. In the particular example being discussed, which is related to the deposition of the coating on a metallic turbine blade, the ambient pressure is approximately 0.05 atmospheres. The plasma gun 16 upstream pressure is approximately 5 atmospheres, to establish for the particular nozzle design a supersonic plasma stream of in excess of approximately Mach 3.2 velocity. The static pressure in the plasma stream is measured in a direction normal to the stream, and is no less than the ambient pressure, and is here slightly greater. Consequently, the plasma stream diverges to a larger cross-sectional area, within a diverging angle no greater than about 15°. The stagnation pressure in the plasma stream is that pressure encountered looking upstream into the stream, and is in effect the static pressure increased by the kinetic energy of the plasma stream. The stagnation pressure is therefore largely determined by stream velocity and stream density, and should be in the range of from 0.001 to 2 atmospheres, but in any event is above the static pressure. Under these conditions, as depicted in graphic form in FIG. 6, the plasma stream creates a shock region having a significant effect upon the transfer arc used in the system.

The process of preparing the workpiece for deposition of a spray coating may be initiated by using the scanning plasma stream, with or without the transfer arc, to heat the workpiece 24 to an adequately high temperature before application of the coating material. For turbine blades, for example, a substantially uniform temperature range of approximately 900° to 1100° C. is reached at the workpiece. Preheating is a useful not a necessary step, and its use depends on the workpiece, substrate material and coating. For turbine blades preheating has been found to be of significant importance because it avoids prestressing due to mismatches in thermal expansion. The sputtering process is initiated and largely completed prior to the feeding of preheated powder from the powder feed mechanism 20 of FIG. 1. Under the stated operative conditions, the plasma ions impinging on the workpiece surface excite atoms in the macrospace or energy drop region of the workpiece surface. The transfer arc is then applied with the transfer arc power supply 50 switched such that the workpiece 24 is connected as the cathode. The transfer arc current that is used is in the range of 50 to 500 amperes, providing a voltage drop of 30 to 80 volts, in this example. The cathodic workpiece thus begins to act as an electron emitter, further increasing the excitation of the workpiece 24 surface, and freeing excited metal atoms in the form of ions from the workpiece. Once freed, ions tend to propagate in accordance with the charges in the plasma stream and the gas dynamic forces of the shock flow. The interaction between the shock pattern and the high energy density transfer arc results in diffusion of the transfer arc over a substantial area, and contributes to a high rate of removal of atoms from the workpiece surface. Oxide films and other impurities present as residue or generated in prior treatments and initial heating are thus removed in a few seconds from the workpiece surface, and the removal can be visually observed through a viewing port of the chamber 10 in the form of intermittent patterns of visible spot radiation that exist for only a short time until the cleaning process, which may be referred to as a sputtering action, is completed.

Once heated and cleaned, the workpiece 24 can immediately receive the coating materials in the plasma stream, and the negative polarity on the workpiece 24 can incipiently be terminated. However, it is found advantageous to maintain a negative polarity on the workpiece for a short interval, in the range of up to 5 seconds, to establish a metallurgically diffused interlinkage on the workpiece surface. This results because the incoming powder clusters in the plasma spray react with ions and free atoms of the highly excited cathodic surface of the preheated workpiece. The interlinkage surface can substantially improve the adherence of the applied coating relative to prior art systems, although significant improvements are derived, at the least in reliability, without employing this technique.

Thereafter, deposition of the desired depth of coating on the workpiece surface proceeds while injecting the preheated powder into the plasma spray for the needed interval during the scanning and other motions of the mechanisms. The transfer arc is reversed to render the workpiece 24 anodic relative to the plasma head 16, after the initial short interface interval, to prevent the sputtering of previously deposited coating particulates concurrent with the deposition of new material. The application of the transfer arc adds heat flux to the workpiece, and if there is excessive heat entry then the transfer arc is not employed. The high current densities, diffused application of the arc, and precleaning of the workpiece not only provide rapid deposition, but achieve bonding characteristics of a level, and with a uniformity, not heretofore attained by previously known systems. These capabilities are of particular benefit in large workpieces and those which must meet critical requirements. For example, an average deposition rate of 1 mil per second over approximately a 3 inch diameter area is utilized, although the parameters of the system can be varied to increase or decrease this rate over a substantial range. The coatings that are produced are oxide free, highly dense and exhibit excellent bond to the substrates. Detailed analyses of turbine blades coated with CoCrAlY across surfaces taken at different points along the length of the turbine blade show a variation between only 2.8 and 3.7 mils. Because of the capability of the system for controlling the movements of the scanning mechanisms, the layer at one particular region can be buttressed or thickened relative to another, as at the leading and trailing edges of the foil section of a turbine blade. The same blade as in the previous blade, using this this approach, had leading edges in excess of 7 mil coating thickness, and a thickness of decreasing amplitude in the direction toward the trailing edge, with a minimum of 3.0 mils along the convex surface of the air foil but with again a further coating of approximately 7 mils thickness at the trailing edge.

The process thus provides a homogeneous coating structure with good ductility and surface smoothness. There is no degradation of the mechanical substrate properties, in terms of tensile stress, rupture, thermal fatigue or low-high cycle fatigue. Finishing treatments, such as polishing, scrubbing and harperizing, can be used to improve surface finish for particular applications. The structure of the coating is of high density and has a porosity typically less than 0.5 to 1%, with the pores being noninterconnected and evenly distributed. Coatings that have been applied utilizing this plasma spray system include the following:

CoCrAlY
CoCrAlHf
CoCrAlY/NiAlCr
CoCrAlY/NiCrAl
CoCrAlY/$Al_2O_3$
CoCrNiTaAlY (S57&67)
NiAlCr
NiCrAlY
NiCoCrAlY
NiCrAlY/$Al_2O_3$
NiCrSiB
1 N 100
NiCr
NiAl
WC-Co
316 stainless steel
Stellite 1
Al
Cu
Co
Mo
Ni The workpiece to be coated may be cleaned initially by grit blasting or by acid etching, or a combination of these or other processes. The workpiece need not be heated using the plasma spray but may be preheated using other conventional means. A purified Argon source or a dehydrogenation or gettering process is not required, because of the cleaning action made possible in accordance with the invention. However, such techniques are not incompatible with the process where they are economically justified by special requirements needed in a particular finished product.

It should also be noted that the motions introduced in the workpiece, dummy sting and the plasma head contribute to the reliable operation. Concurrent constant movement prevent localized heat buildups, and vary the concentration of the ion and electron populations in the drop regions at the workpiece. Where the workpiece has a configuration, such as an interior corner, that might tend to receive deflected molten particles that would be weakly bonded, the gooseneck mechanism may be yawed in synchronism with the plasma head so that only directly impinging particles are deposited. Further, the uniformity of the coating action is maintained throughout the length of the workpiece, because the adjacent end of dummy sting provides another impingement region for the plasma stream shock pattern, and continues diffusion of the attaching arc, which would otherwise be uncontrolled by the shock phenomenon.

While various forms and modifications have been suggested, it will be appreciated that the invention is not limited thereto but encompasses all expedients and variations falling within the scope of the appended claims.

What is claimed is:

1. A transfer arc plasma system comprising:
- a plasma gun positioned in operative relation to a workpiece and providing a supersonic plasma stream of substantially inert gas;
- enclosure means providing a low static pressure environment about the plasma gun and workpiece;
- means coupled to the workpiece for selectively establishing both a cathodic and an anodic relationship of the workpiece relative to the plasma gun and including means for selectively switching between the cathodic and anodic relationships; and
- means for injecting spray powder into the plasma stream for deposition on the workpiece.

2. The invention as set forth in claim 1 above, wherein the combination of supersonic plasma stream and ambient pressure provide a diffused shock pattern adjacent the workpiece and distribute the transfer arc across an area of the workpiece when a cathodic relationship is established at the workpiece relative to the plasma gun.

3. The invention as set forth in claim 2 above, wherein the plasma stream is at in excess of Mach 3 and the ambient pressure is in the range of 0.001 to 0.6 atmospheres.

4. The invention as set forth in claim 3 above, wherein the means for selectively switching includes means for switching to the cathodic relationship for a time prior to the injection of spray powder, and wherein the cathodic potential relative to the plasma gun is in excess of about 20 volts and the transfer arc current is in excess of 50 amperes.

5. A transfer arc plasma system comprising:
- a plasma gun positioned in operative relation to a workpiece and providing a supersonic plasma stream of substantially inert gas;
- enclosure means providing a low static pressure environment about the plasma gun and workpiece;
- means coupled to the workpiece for selectively establishing a cathodic or anodic relationship between the workpiece and plasma gun;
- means for injecting spray powder into the plasma stream for deposition on the workpiece;
- the combination of supersonic plasma stream and ambient pressure providing a diffused shock pattern adjacent the workpiece and distributing the transfer arc across an area of the workpiece;
- the means for establishing a cathodic or anodic relationship including means for switching to the cathodic relationship for a time prior to the injection of spray powder;
- the cathodic potential relative to the plasma gun being in excess of about 20 volts and the transfer arc current being in excess of 50 amperes;
- means coupled to move the plasma gun to scan the workpiece; and
- means providing a dummy workpiece surface adjacent the workpiece, for distributing the arc attachment area despite the position of the impingement area of the plasma stream relative to the workpiece.

6. The invention as set forth in claim 5 above, wherein the plasma stream has a velocity of at least Mach 3.2, wherein the static pressure of the stream is at least equal to the ambient pressure, and wherein the stagnation pressure of the stream is from 0.001 to 2 atmospheres.

7. The invention as set forth in claim 6 above, wherein the ambient pressure is approximately 0.05 atmospheres, and including in addition means coupled to rotate the workpiece during spraying.

8. A system for depositing an intimate high temperature resistant coating on a large area workpiece, comprisng the combination of:
- a plasma gun positioned in operative relation to the workpiece;
- enclosure means defining a low pressure environment about the plasma gun and workpiece;
- plasma gun positioning means coupled to provide motion of the plasma gun in at least two axes of movement within the enclosure means;
- DC power supply means coupled to the plasma gun anode and cathode;
- conductive workpiece support means coupled to the enclosure and coupled to support the workpiece within the enclosure in a desired position;
- reversible DC power supply means coupled to the plasma gun and to the workpiece support mechanism, for establishing a potential difference of both polarities at the workpiece relative to the plasma gun;
- means providing a flow of essentially inert gas to the plasma gun such that a supersonic plasma stream is directed from the plasma gun onto the workpiece; and
- means adjacent the plasma gun for injecting a powder to be coated onto the workpiece into the plasma stream.

9. The invention as set forth in claim 8 above, wherein the plasma stream velocity and the static pressure are selected to establish a shock pattern adjacent the workpiece surface, and further including control means coupled to the reversible polarity power supply for establishing a cathodic workpiece potential approximately concurrent with the initiation of the coating sequence.

10. The invention as set forth in claim 9 above, wherein the control means reverses the potential of the switchable power supply to establish the workpiece as an anode for normal coating operation.

11. A system for depositing an intimate high temperature resistant coating on a large area workpiece, comprising the combination of:
- a plasma gun positioned in operative relation to the workpiece;
- enclosure means defining a low pressure environment about the plasma gun and workpiece;
- plasma gun positioning means coupled to provide motion of the plasma gun in at least two axes of movement within the enclosure means;
- DC power supply means coupled to the plasma gun anode and cathode;
- conductive workpiece support means coupled to the enclosure and coupled to support the workpiece within the enclosure in a desired position;
- reversible DC power supply means coupled to the plasma gun and to the workpiece support mechanism, for establishing a potential difference of either polarity between the workpiece and the plasma gun;

means providing a gas flow to the plasma gun such that a high velocity plasma stream is directed from the plasma gun onto the workpiece;

means adjacent the plasma gun for injecting a powder to be coated onto the workpiece into the plasma stream;

the plasma stream velocity and the static pressure being selected to establish a shock pattern adjacent the workpiece surface;

control means coupled to the reversible polarity power supply for establishing a cathodic workpiece potential approximately concurrent with the initiation of the coating sequence;

the control means reversing the potential of the switchable power supply to establish the workpiece as an anode for normal coating operation; and a dummy target positioned adjacent the workpiece.

12. The invention as set forth in claim 11 above, wherein said plasma gun motion mechanism includes means for moving the plasma gun in a traverse direction parallel to the plane of the workpiece, and in the vertical direction relative to the plane of the workpiece.

13. The invention as set forth in claim 12 above, wherein said plasma gun motion mechanism further includes means for moving the plasma gun in yaw motions parallel and perpendicular to the plane of the workpiece, and wherein said system further includes means for rotating the workpiece, and dummy sting means positioned in spaced apart relation to the workpiece within the enclosure.

14. The invention as set forth in claim 13 above, wherein the static pressure is at approximately 0.05 atmospheres, wherein the plasma flow is in excess of Mach 3.2, and wherein the system further includes gas pumping means coupled to said enclosue means for maintaining the low pressure environment under gas flow through the plasma gun.

15. The method of depositing a metallurgically bonded coating on a substrate comprising the steps of:

directing a supersonic plasma flow toward the substrate;

cleaning the substrate by sputtering material from the surface in counterflow to the plasma flow; and injecting a powder of a material to be coated on the substrate into the plasma stream for deposition on the cleaned surface.

16. The method as set forth in claim 15 above, wherein the cleaning step comprises establishing the substrate as a cathodic element and sputtering atoms from the surface thereof.

17. The method as set forth in claim 16 above, wherein the system utilizes a transferred arc plasma gun, and wherein sputtering is effected by maintaining the substrate negative relative to the plasma gun.

18. The method as set forth in claim 17 above, wherein the supersonic plasma flow is in excess of Mach 3, and further including the step of maintaining the stagnation pressure of the plasma flow between 0.001 to 2 atmospheres, such that a distributed shock pattern is established on the substrate and diffuses the transfer arc.

19. The method as set forth in claim 18 above, wherein the ambient pressure is in the range of 0.001 to 0.6 atmospheres, and wherein the static pressure in the stream is slightly greater than the ambient pressure, such that the stream diverges slightly.

20. A method for coating high temperature materials on a workpiece comprising the steps of:

establishing a distributed plasma shock pattern adjacent and against the workpiece by directing a supersonic plasma stream against the workpiece in a low static pressure environment;

forcing emissions of atoms of material from the surface of the workpiece against the plasma stream; and injecting spray powder into the plasma stream for deposition on the prepared surface of the workpiece.

21. The method as set forth in claim 20 above, wherein the atoms of material are emitted by excitation of the workpiece surface under the plasma stream and the emission of electrons from the workpiece surface.

22. The method as set forth in claim 21 above, wherein the plasma stream composition, velocity and the static pressure of the workpiece environment are selected to distribute the shock pattern over a substantial area of the workpiece.

23. The method as set forth in claim 22 above, wherein the emissions of material from the workpiece surface are terminated at least substantially concurrently with initiation of the injection of powder into the plasma stream.

24. The method as set forth in claim 23 above, wherein the stagnation pressure in the shock pattern is in excess of about 1 atmosphere and the ambient pressure of the environment about the plasma flow is below about 0.6 atmospheres, and wherein the plasma stream comprises substantially inert gas.

25. The method as set forth in claim 24 above, wherein the supersonic plasma flow is in excess of Mach 3, and wherein the method utilizes a transferred arc plasma gun and the material is emitted from the workpiece by establishing a cathodic potential on the workpiece relative to the plasma gun.

26. The method as set forth in claim 25 above, wherein the cathodic potential is in excess of about 20 volts and the transfer arc current is in excess of 50 amperes.

27. The method of depositing a coating on a large area workpiece comprising the steps of:

directing a supersonic stream of ionized gas against the workpiece to create a stream diffusing shock pattern in the region of the workpiece;

cleaning the surface of the workpiece by a reverse atom and electron flow from the workpiece to the ionized gas stream;

injecting a powder of the material to be coated into the stream for impingement on the workpiece while the reverse flow is continuing such that an interface layer is deposited comprising intermingled atoms of coating and workpiece material; and terminating the reverse flow while continuing the powder injection to deposit the coating on the interface layer.

28. A system for depositing a high temperature coating on a workpiece, comprisng:

a transferred arc plasma gun system positioned in operative relation to the workpiece;

enclosure means defining a low pressure environment about the plasma gun and workpiece;

means coupled to the plasma gun and workpiece for establishing a controllably reversible electrical potential between the plasma gun and workpiece to selectively make the workpiece positive and negative relative to the plasma gun;

means coupled to the plasma gun for providing a plasma stream having a velocity in excess of Mach 3; and means adjacent the plasma gun for injecting a powder to be coated onto the workpiece into the plasma stream.

29. The invention as set forth in claim 28, above, wherein the means defining a low pressure environment maintains ambient pressure about the plasma stream of no greater than 0.6 atmospheres; the velocity of the plasma stream, the nature of the plasma gun and the static pressure providing a plasma shock pattern adjacent said workpiece.

30. A plasma spray system for coating a workpiece comprising:

means defining a vacuum enclosure;

workpiece holder means disposed within the enclosure in a target region;

plasma gun means disposed within the vacuum enclosure for directing a supersonic plasma stream containing a coating material onto the workpiece;

means coupled to the plasma gun means for scanning the plasma gun means in at least two orthogonal directions of motion relative to the workpiece; and transfer arc power supply means coupled to the plasma gun means and the workpiece for maintaining a potential difference of one polarity therebetween sufficient to establish a transfer arc, and a potential difference of opposite polarity sufficient to sputter material from the workpiece surface whereby impurities are removed.

31. A system as set forth in claim 30 above, wherein the means for scanning the plasma gun means comprises a traverse scan mechanism, and first yaw means for scanning the plasma gun means in a direction substantially normal to the traverse direction.

32. A system as set forth in claim 31 above, wherein the traverse scan mechanism and first yaw means includes velocity control means.

33. A system as set forth in claim 32 above, wherein the means defining a vacuum enclosure and the plasma gun means provide an ambient pressure, stream velocity and stream static pressure which create a shock region at the workpiece that diffuses the transfer arc attachment area.

34. A system as set forth in claim 32 above, including in addition vertical scan means coupled to the plasma gun means for providing a reciprocating motion to the plasma gun means in a direction toward and away from the workpiece, the vertical scan means being controllable in velocity.

35. A system as set forth in claim 34 above, including in addition second yaw means coupled to the plasma gun means, the second yaw means providing a yaw motion parallel to the traverse axis and being controllable in velocity.

36. A system as set forth in claim 35 above, wherein the traverse scan mechanism comprises elongated guide means disposed along the traverse axis, a carriage coupled to support the plasma gun means, and traverse drive means for reciprocating the carriage along the guide means, and wherein the first yaw means comprises means for pivotting the guide means about an axis parallel to the traverse axis.

37. A system as set forth in claim 36 above, wherein the second yaw means includes a gimbal mechanism coupling the plasma gun means to the carriage, and means for pivotting the gimbal mechanism about an axis normal to the traverse axis, and wherein the vertical drive means comprises a rack and pinion mechanism coupling the gimbal mechanism to the plasma gun means.

38. A system as set forth in claim 37 above, including in addition drive means coupled to the workpiece holder means for rotating the workpiece at controllable velocity.

39. A system as set forth in claim 38 above, including in addition dummy sting means disposed adjacent but spaced apart from the workpiece, the dummy sting means being rotatable at controllable velocity.

40. A system as set forth in claim 39 above, wherein the workpiece holder means includes means for introducing a yaw motion in the workpiece concurrent with rotation thereof.

* * * * *

REEXAMINATION CERTIFICATE (753rd)

United States Patent [19]

Muehlberger et al.

[11] B1 4,328,257

[45] Certificate Issued Sep. 1, 1987

[54] SYSTEM AND METHOD FOR PLASMA COATING

[75] Inventors: Erich Muehlberger, San Clemente; Roland D. Kremith, Newport Beach, both of Calif.

[73] Assignee: Electro-Plasma, Inc., Irvine, Calif.

Reexamination Request:
No. 90/001,030, Jun. 9, 1986

Reexamination Certificate for:

| | |
|---|---|
| Patent No.: | **4,328,257** |
| Issued: | **May 4, 1982** |
| Appl. No.: | **97,723** |
| Filed: | **Nov. 26, 1979** |

[51] Int. Cl.[4] ..... B05D 1/08
[52] U.S. Cl. ..... 427/34; 219/121 P
[58] Field of Search ..... 427/34, 38, 423; 219/76.16, 121 P

[56] References Cited

U.S. PATENT DOCUMENTS

| | | | |
|---|---|---|---|
| 2,424,418 | 7/1947 | Rory . | |
| 2,722,869 | 1/1960 | Giannini et al. . | |
| 3,010,009 | 11/1961 | Ducati | 427/34 |
| 3,179,783 | 4/1965 | Johnson | 219/76.16 |
| 3,493,415 | 2/1970 | Grisaffe et al. | 427/34 |
| 3,494,852 | 2/1970 | Doctoroff | 219/76.16 |
| 3,507,248 | 4/1970 | Seeley et al. | 204/298 |
| 3,838,244 | 9/1974 | Petrides et al. | 219/131 F |
| 3,839,618 | 10/1974 | Muehlberger | 427/34 |
| 4,006,340 | 2/1977 | Gorinas | 427/34 |
| 4,058,698 | 11/1977 | Bykhovsky et al. | 219/121 P |

FOREIGN PATENT DOCUMENTS

| | | |
|---|---|---|
| 2046227 | 3/1972 | Fed. Rep. of Germany . |
| 2435021 | 2/1976 | Fed. Rep. of Germany . |
| 2224991 | 10/1974 | France . |
| 2346092 | 10/1977 | France . |
| 40-025402 | 11/1965 | Japan . |
| 50-030591 | 12/1975 | Japan . |
| 51-022633 | 2/1976 | Japan . |
| 845410 | 8/1960 | United Kingdom . |
| 869791 | 6/1961 | United Kingdom . |
| 930436 | 7/1963 | United Kingdom . |
| 1030937 | 5/1966 | United Kingdom . |
| 1242004 | 8/1971 | United Kingdom . |
| 1461484 | 1/1977 | United Kingdom . |

*Primary Examiner*—John H. Newsome

[57] ABSTRACT

Uniform protective coatings are deposited on components with a high strength bond by utilizing a supersonic plasma stream and a transferred arc system of selectively reversible polarity. By maintaining plasma stream velocity at a sufficiently high Mach number, and using stream temperatures and static pressures which establish a shock pattern characteristic that diffuses the arc, the workpiece is made cathodic relative to the plasma gun at predetermined intervals. This creates a sputtering effect in which electrons and atoms are ejected from the workpiece despite the impacting plasma flow and the ambient pressure level. This sputtering action is undertaken to clean the workpiece once it is sufficiently heated and to cause intermingling of molecules of the substrate material with molecules of a deposition powder injected into the plasma flow. This preparatory deposition, together with the clean workpiece surface, enables a subsequent buildup of securely bonded and high uniform material.

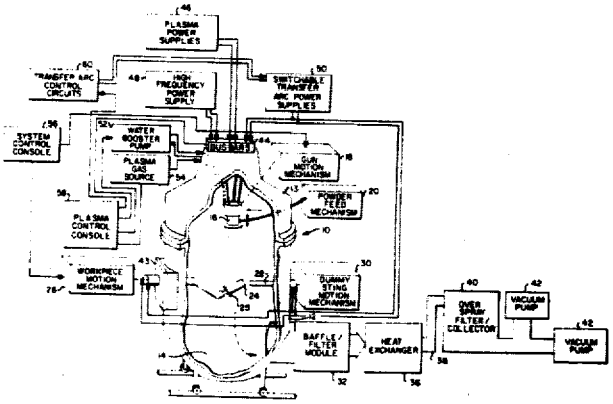

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–14 and 27–40 is confirmed.

Claims 16 and 22 are cancelled.

Claims 15, 17, 18, 20, 21 and 23 are determined to be patentable as amended.

Claims 19 and 24–26, dependent on an amended claim, are determined to be patentable.

15. The method of depositing a metallurgically bonded coating on a substrate comprising the steps of:

directing a supersonic plasma flow toward the substrate *in the presence of a vacuum source which provides an ambient pressure of substantially less than 1.0 atmospheres and a plasma stream velocity of at least Mach 2–3 to establish a distributed plasma shock pattern adjacent and against a substantial surface area of the substrate;* cleaning *substantially the entire surface area of* the substrate by [sputtering] *establishing the substrate as a cathodic element to sputter* material from the surface in counterflow to the plasma flow *in a dispersed pattern provided by the distributed plasma shock pattern;* [and]

injecting a powder of a material to be coated on the substrate into the plasma stream for deposition on the cleaned surface *while maintaining the substrate as a cathodic element to establish a base coating of the material on the substrate; and*

*establishing the substrate as an anodic element while continuing to inject a powder of a material to be coated on the substrate into the plasma stream to provide a further coating of the material on the base coating.*

17. The method as set forth in claim [16] *15* above, wherein the system utilizes a transferred arc plasma gun, and wherein [sputtering] *establishing the substrate as a cathodic element* is effected by maintaining the substrate negative relative to the plasma gun.

18. The method as set forth in claim 17 above, wherein the supersonic plasma flow is in excess of Mach 3, and [further including the step of maintaining] the stagnation pressure of the plasma flow *is maintained* between 0.001 to 2 atmospheres, such that [a] *the* distributed *plasma* shock pattern is established on the substrate and diffuses the transfer arc.

20. A method for coating high temperature materials on a workpiece comprising the steps of:

[establishing a distributed plasma shock pattern adjacent and against the workpiece by] directing a supersonic plasma stream against the workpiece in a low static pressure environment *to establish a distributed plasma shock pattern adjacent and against a substantial surface area of the workpiece;*

[forcing emissions of atoms of] *cleaning substantially the entire surface area of the workpiece by sputtering* material from the surface of the workpiece against the plasma stream *in a dispersed pattern provided by the distributed plasma shock pattern;* and injecting spray powder into the plasma stream for deposition on the [prepared] surface of the workpiece, *the cleaning of substantially the entire surface area of the workpiece being terminated at least substantially concurrently with initiation of the injection of powder into the plasma stream.*

21. The method as set forth in claim 20 above, wherein the [atoms of material are emitted] *cleaning of substantially the entire surface area of the workpiece comprises forcing emissions of atoms of material from the surface of the workpiece* by excitation of the workpiece surface under the plasma stream and the emission of electrons from the workpiece surface.

23. [The method as set forth in claim 22 above, wherein] *A method for coating high temperature materials on a workpiece comprising the steps of:*

*establishing a distributed plasma shock pattern adjacent and against the workpiece by directing a supersonic plasma stream against the workpiece in a low static pressure environment;*

*forcing emissions of atoms of material from the surface of the workpiece against the plasma stream; and*

*injecting spray powder into the plasma stream for deposition on the prepared surface of the workpiece;*

*wherein the atoms of material are emitted by excitation of the workpiece surface under the plasma stream and the emission of electrons from the workpiece surface, the plasma stream composition, velocity and the static pressure of the workpiece environment are selected to distribute the shock pattern over a substantial area of the workpiece, and* the emissions of material from the workpiece surface are terminated at least substantially concurrently with initiation of the injection of powder into the plasma stream.

* * * * *